US008640278B2

(12) United States Patent
You et al.

(10) Patent No.: US 8,640,278 B2
(45) **Date of Patent: *Feb. 4, 2014**

(54) ADJUSTMENT MECHANISM FOR ALTERING HEIGHT OF BABY PLAYPEN

(75) Inventors: Youn-Fu You, Chang Hua (TW); Ho-Sheng Chen, Chiayi County (TW); Ching-Hsing Kuo, Tainan (TW)

(73) Assignee: Lerado(Zhong Shan)Industrial Co., Ltd, Guang Dong Province (CN)

( * ) Notice: Subject to any disclaimer, the term of this patent is extended or adjusted under 35 U.S.C. 154(b) by 174 days.

This patent is subject to a terminal disclaimer.

(21) Appl. No.: 13/213,110

(22) Filed: Aug. 19, 2011

(65) Prior Publication Data

US 2012/0042447 A1 Feb. 23, 2012

(30) Foreign Application Priority Data

Aug. 23, 2010 (CN) ..... 2010 2 0503138 U

(51) Int. Cl.
*A47C 31/00* (2006.01)

(52) U.S. Cl.
USPC ..... 5/11; 5/93.1; 5/99.1

(58) Field of Classification Search
USPC ..... 5/93.1, 98.1, 99.1, 11
See application file for complete search history.

(56) References Cited

U.S. PATENT DOCUMENTS

| | | | | |
|---|---|---|---|---|
| 3,202,454 | A * | 8/1965 | Neidlinger | 296/100.16 |
| 3,848,277 | A * | 11/1974 | Reguitti | 5/11 |
| 4,982,463 | A * | 1/1991 | Burnham | 5/11 |
| 5,339,470 | A * | 8/1994 | Shamie | 5/98.1 |
| 5,349,709 | A * | 9/1994 | Cheng | 5/93.1 |
| 6,332,231 | B1 * | 12/2001 | Wang | 5/507.1 |
| 7,055,191 | B1 * | 6/2006 | Chen | 5/93.2 |
| 7,526,821 | B2 * | 5/2009 | Chen et al. | 5/98.1 |
| 7,543,342 | B2 * | 6/2009 | Zhao et al. | 5/93.1 |
| 2007/0061961 | A1 * | 3/2007 | Shamie | 5/93.1 |
| 2008/0115269 | A1 * | 5/2008 | Chen et al. | 5/99.1 |
| 2012/0211713 | A1 * | 8/2012 | You et al. | 256/25 |

* cited by examiner

*Primary Examiner* — Robert G Santos
*Assistant Examiner* — Richard G. Davis
(74) *Attorney, Agent, or Firm* — CKC & Partners Co., Ltd.

(57) ABSTRACT

An adjustment mechanism for altering a height of a baby playpen from the ground to a bottom of the baby playpen is disclosed. The adjustment mechanism includes a foldable skeleton, a seat fabric slideably put on the foldable skeleton to construct a plurality of side surface and a bottom surface for forming an accommodation space, and a height adjustment positioning mechanism disposed between the foldable skeleton and the seat fabric thereby altering the height of the bottom surface from the ground by adjusting the seat fabric.

3 Claims, 7 Drawing Sheets

ADJUSTMENT MECHANISM FOR ALTERING HEIGHT OF BABY PLAYPEN

RELATED APPLICATIONS

The application claims priority to China Application Serial Number 201020503138.0, filed Aug. 23, 2010, which is herein incorporated by reference.

BACKGROUND

1. Field of Invention

The present invention relates to an adjustment mechanism for altering a height of a baby playpen from the ground to a bottom of the baby playpen.

2. Description of Related Art

A baby playpen is a carrier which can provide a confined space for a baby to play therein, and is often used outdoors. For carrying convenience, most of the baby playpens have the developed and folded states. A basic structure of a conventional baby playpen includes a foldable skeleton, a woven fabric and a mattress, wherein the foldable skeleton is formed by connecting a plurality of poles, and the woven fabric is put on the foldable skeleton to form an accommodation space with a bottom and four sides. Since the woven fabric is usually a thin layer fixed on the connected foldable skeleton and fails to support a baby, it is necessary to place a mattress on the bottom to support the baby. Since the woven fabric is fixed on the skeleton and there are a certain height between a bottom of the woven fabric and a top edge of the skeleton, it is difficult for a baby sitter to hold a baby who still cannot stand up from the mattress. Thus, most of the baby playpens in the market have a three-layer mattress. However, the use of the three-layer mattress not only increases the volume of transported material but also increases the manufacturing cost. China Patent No. ZL200820177109.2 discloses a baby playpen including a woven fabric which is disposed around the accommodation space constructed by a skeleton, a mattress which is a foldable mattress placed on the bottom of the accommodation space, wherein the side of the bottom of the accommodation space has engagement portions with which struts are engaged. This conventional baby playpen advantageously uses the effect of conveniently folding the mattress and the function of supporting the mattress by using the struts disposed on the bottom of the playpen. However, this conventional baby playpen has the disadvantages of failing to alter the height of the mattress from the ground, and thus is inconveniently used by different children.

SUMMARY

An object of the present invention is to provide an adjustment mechanism for altering a height of a baby playpen from a ground to a bottom of the baby playpen and thereby a upper plate of a walker can be positioned on different locations, hence a baby can learn how to walk in different ways.

The adjustment mechanism of the present invention includes a foldable skeleton, a seat fabric slideably put on the foldable skeleton to construct a plurality of side surface and a bottom surface for forming an accommodation space, and a height adjustment positioning mechanism disposed between the foldable skeleton and the seat fabric thereby altering the height of the bottom surface from the ground by adjusting the seat fabric.

In addition, the foldable skeleton is formed by assembling an upper foldable surrounding set, a bottom frame set and a plurality of vertical poles which are disposed between the upper foldable surrounding set and the bottom frame set. The height adjustment positioning mechanism can comprise a hook connected to an upper edge of a side of the seat fabric and a plurality of positioning portions disposed on the foldable skeleton, wherein the hook is engaged with one of the positioning portions so as to fix the height of the bottom surface from the ground; the height adjustment positioning mechanism also can be that each of the vertical poles has a guide slot of which a sidewall has a plurality of positioning holes, and the height adjustment positioning mechanism comprises a slide base which is connected with the seat fabric and can slide upwards and downwards along the guide slot, and a positioning pole slidably disposed between the vertical pole and the slide base, wherein the height of the bottom surface from the ground is fixed by engaging the positioning pole with one of the positioning holes, wherein an elastic element is disposed between the positioning pole and the slide base for keeping the engagement between the positioning pole and the positioning hole; the height adjustment positioning mechanism also can comprise an adjustment stripe connected to an upper edge of the side of the seat fabric and a length adjuster disposed on the foldable skeleton, wherein the height of the bottom surface from the ground is adjusted by adjusting the adjustment stripe. The length adjuster is disposed on a lower corner stand of the foldable skeleton, and the length adjuster is also disposed between two adjustment stripes, wherein a support plate is fixed on a plane of the bottom frame set, and a plurality of vertical plates are connected between the bottom surface of the seat fabric and the support plate, and when moving upwards, the bottom surface of the seat fabric forms a receiving space together with the support plate, and the vertical plates.

The advantages of the adjustment mechanism of the present invention are described as follows.

1. The foldable skeleton can be developed as a fixed developed state with a straight line, or a folded state with a parallel V shape. Hence, when not in use, the playpen of the present invention can be folded for greatly saving space.

2. There are several height adjustment mechanisms disposed on the vertical poles, and thus the height of the bottom surface from the ground can be altered according to the edge of the seat fabric described to be adjusted.

3. Using the hooks, the guide slots or stripes to control the folding of the seat fabric can conveniently alter the height of the bottom surface from the ground.

4. A support plate is fixed on a plane of the bottom frame set, and soft vertical plates are disposed on two sides of the bottom, thereby forming a receiving space for receiving daily supplies.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
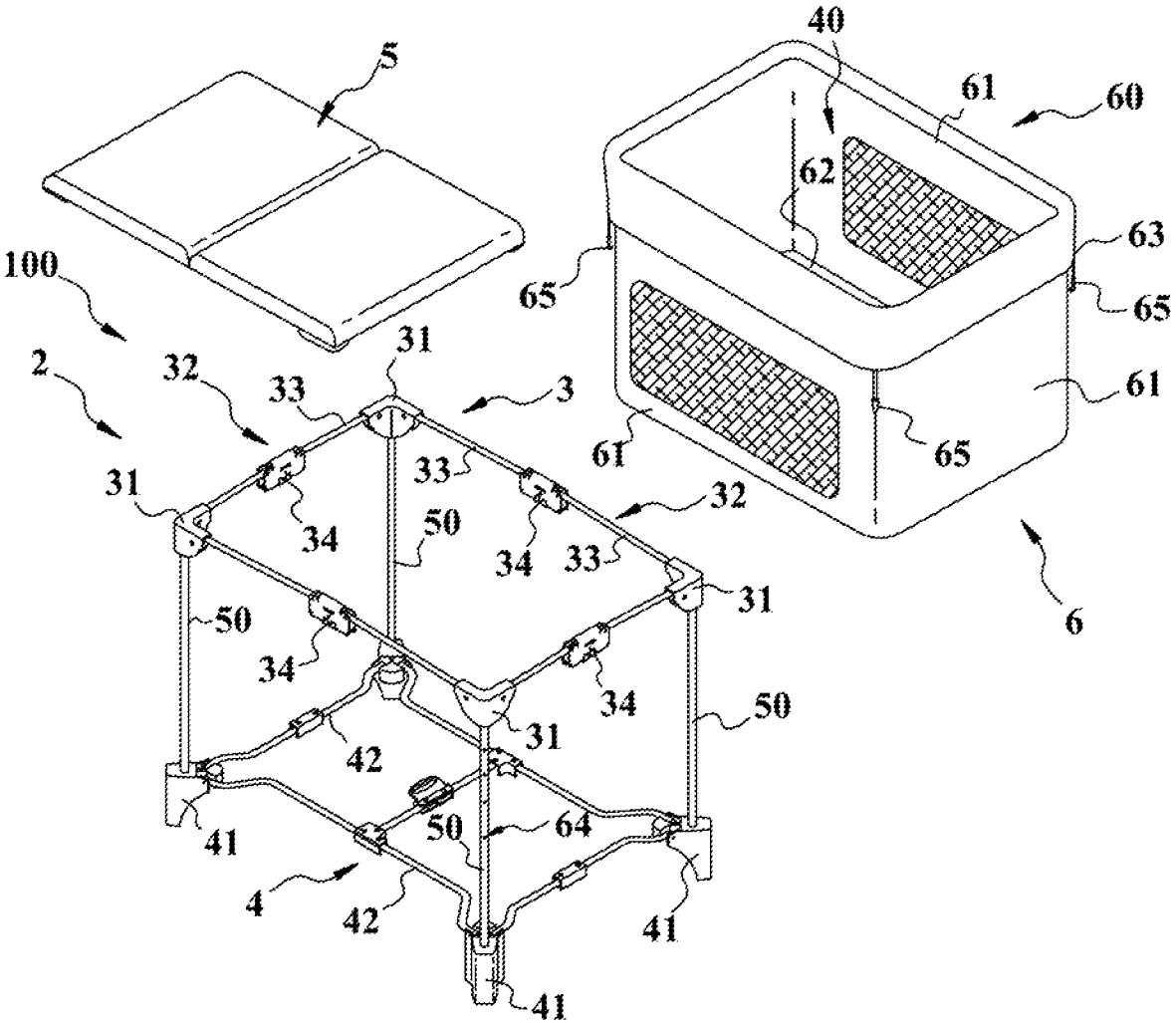
FIG. 1 is a schematic three-dimensional view of a baby playpen.

Reference will now be made in detail to the present embodiments of the invention, examples of which are illustrated in the accompanying drawings. Wherever possible, the same reference numbers are used in the drawings and the description to refer to the same or like parts.

The structure of an adjustment mechanism for altering a height of a baby playpen from a ground to a bottom of the baby playpen is described below:

As shown in FIG. 1, the adjustment mechanism includes a foldable skeleton 2, a seat fabric 60, a foldable mattress 5, and a height adjustment positioning mechanism 6.

The foldable skeleton 2 includes a upper foldable surrounding set 3, a bottom frame set 4 and a plurality of vertical poles 50, wherein the upper foldable surrounding set 3 comprise a plurality of upper corner holders 31 and upper foldable frames 32, wherein the upper corner holders 31 are disposed on four corners of the foldable skeleton 2 (when it is a triangle baby playpen, the upper corner holders are disposed on three corners of the foldable skeleton) and connect with the upper foldable frames 32.

Figure 2:
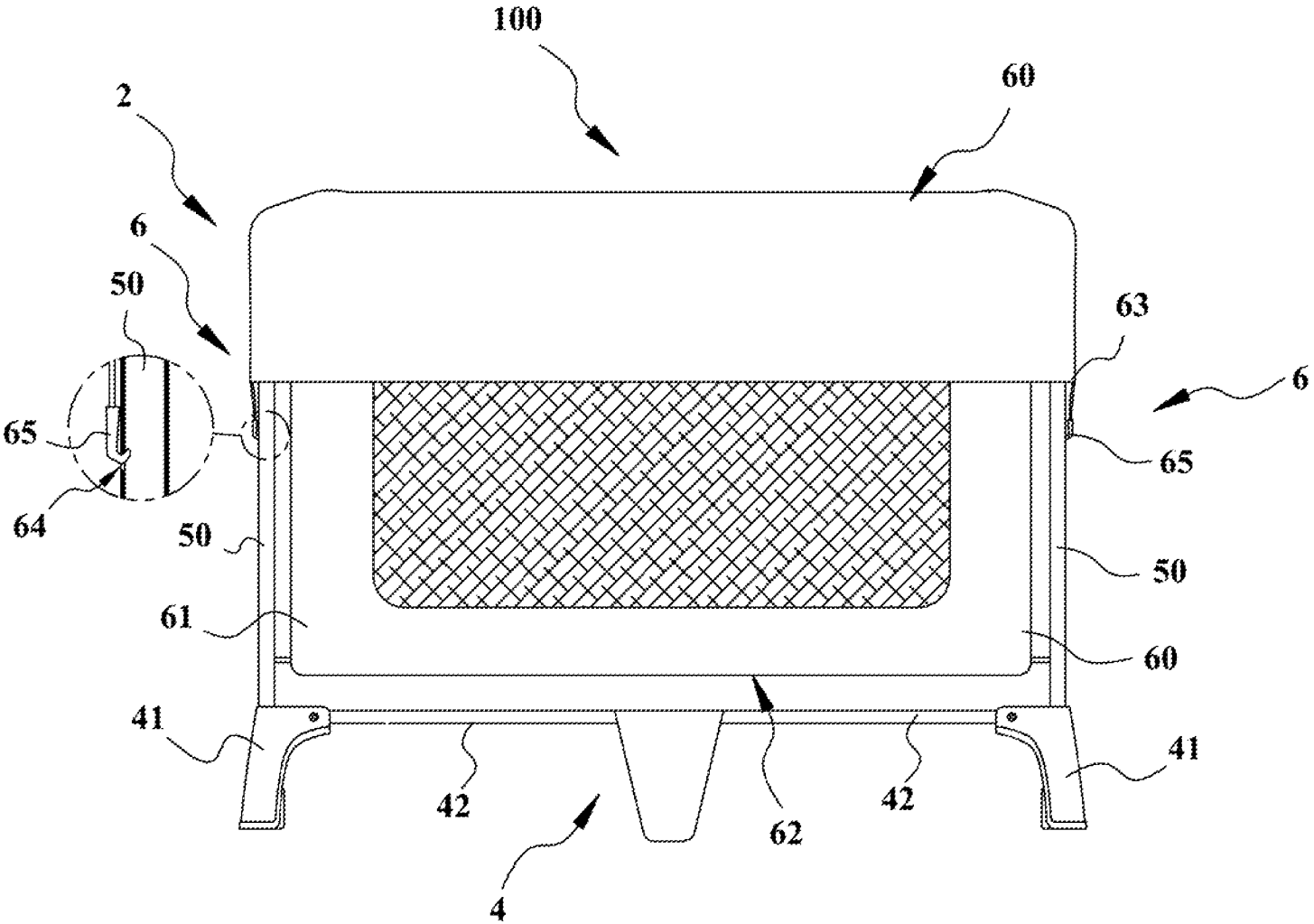
FIG. 2 is a schematic side view of the baby playpen.
Figure 7:
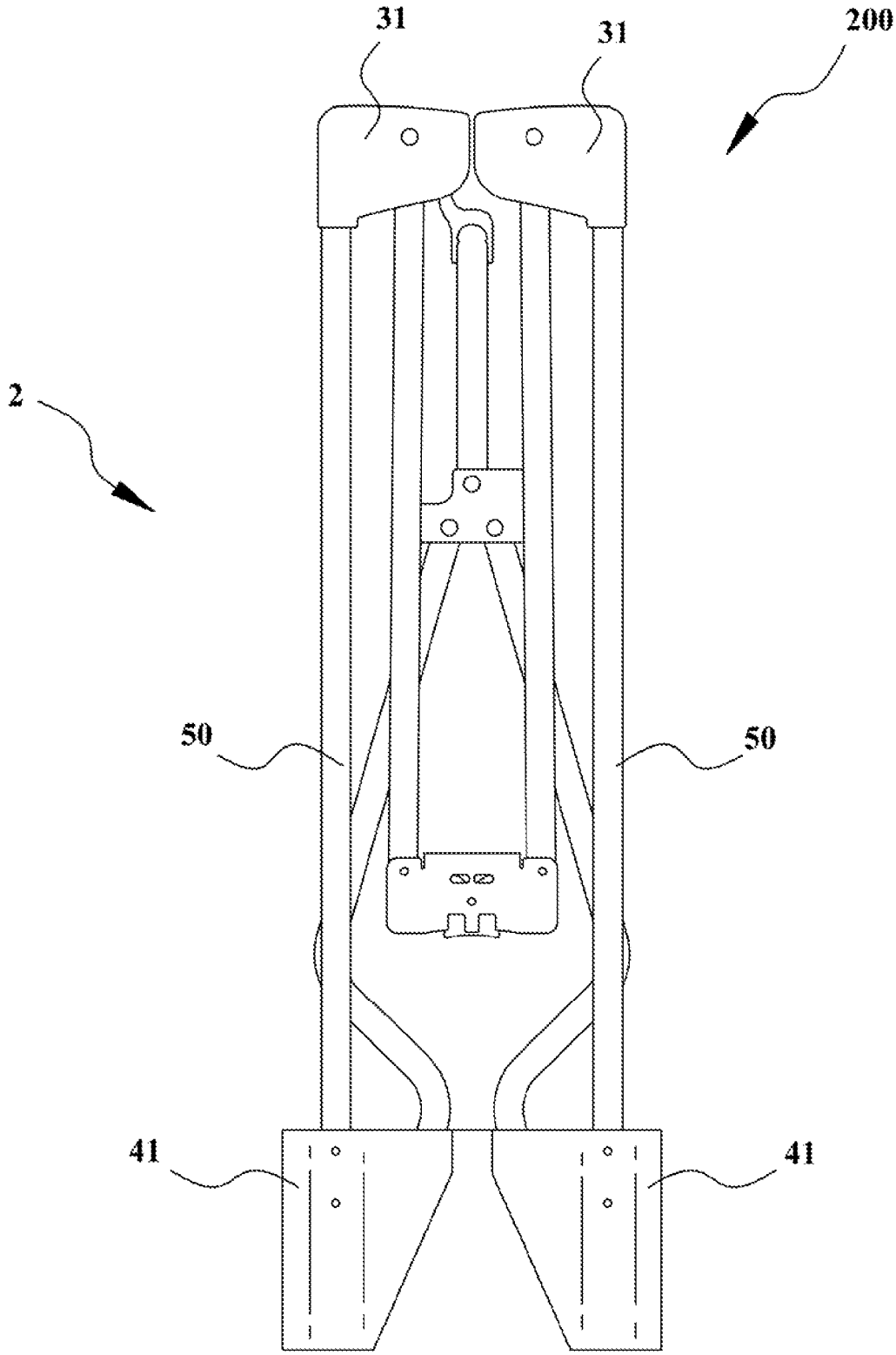
FIG. 7 is a schematic view shown the skeleton in a folded state.

One upper foldable frame 32 is composed of a pair of struts 33 and a release set 34, wherein the pair of struts 33 can construct a fixed developed state 100 with a straight line as shown in FIG. 2 or a folded state 200 with a V shape as shown in FIG. 7 through the release set 34.

The bottom frame set 4 includes a plurality of lower corner stands 41 and a plurality of lower struts 42, wherein the vertical pole 50 is connected between the upper corner holder 31 and the lower corner stand 41.

The height adjustment positioning mechanism 6 is disposed between the foldable skeleton 2 and the seat fabric 60 to support the position of baby by altering the height of a bottom surface 62 of the seat fabric 60, and the seat fabric 60 is slideably disposed on the foldable skeleton 2 to form a plurality of sides 61 and the bottom surface 62 which form an accommodation space 40. Preferably, the bottom surface 62 can become the foldable mattress 5 constructed by elastic material such as a woven fabric covering resin cotton or foam, etc., and a support plate, wherein the support plate may be wood plate or plastic plate. A top edge 63 of each of the sides 61 of the woven fabric crosses over an upper foldable surrounding set 3 of the foldable skeleton 2 and is positioned on the outer side of the foldable skeleton 2.

Figure 3:
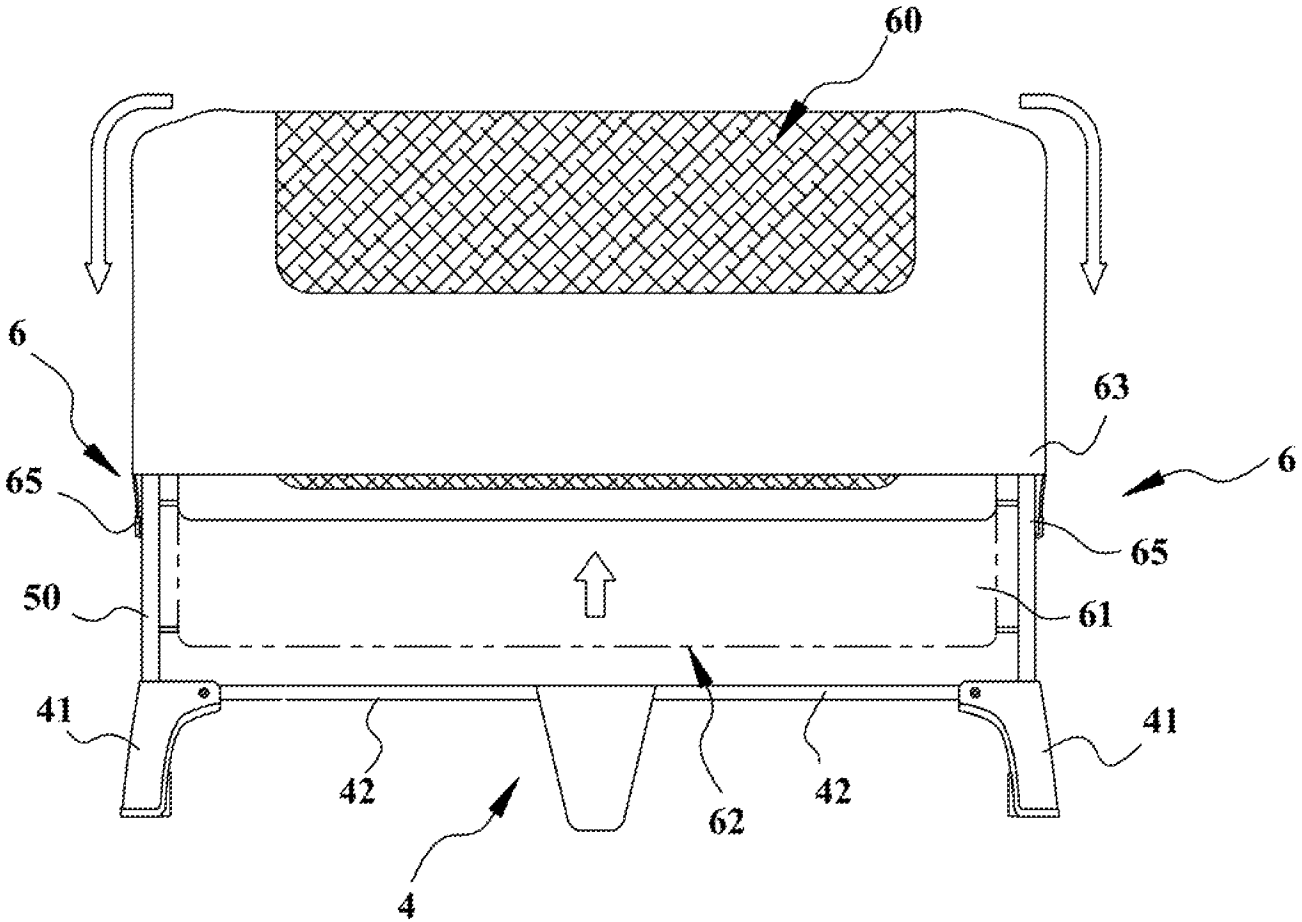
FIG. 3 is a schematic view showing the movement of altering a height of the bottom of a seat fabric from the ground.

As shown in FIG. 2, the height adjustment positioning mechanism 6 includes positioning portions 64 disposed on the vertical poles 50, and hooks 65 which can be engaged with the positioning portions 64, wherein the positioning portions 64 may be the holes which are equally or unequally spaced, and the hooks 65 are disposed on the top edges 63 of the four sides 61 of the seat fabric 60, especially at the corners, or extending from the top edges 63. If being extended by using fabric stripes, the hooks 65 are enabled to select and engage with the positioning portions 64, thereby fixing the bottom surface 62 of the seat fabric 60 at a certain height above the plane of the bottom frame set 4. As shown in FIG. 3, an operator may change the position of the hooks 65 to pull the top edges 63 of the seat fabric 60 to move towards outside and extend downwards, thereby moving the bottom surface 62 upwards, thus achieving the purpose of altering the height of the bottom surface 62 of the seat fabric 60 from the ground.

Figure 4:
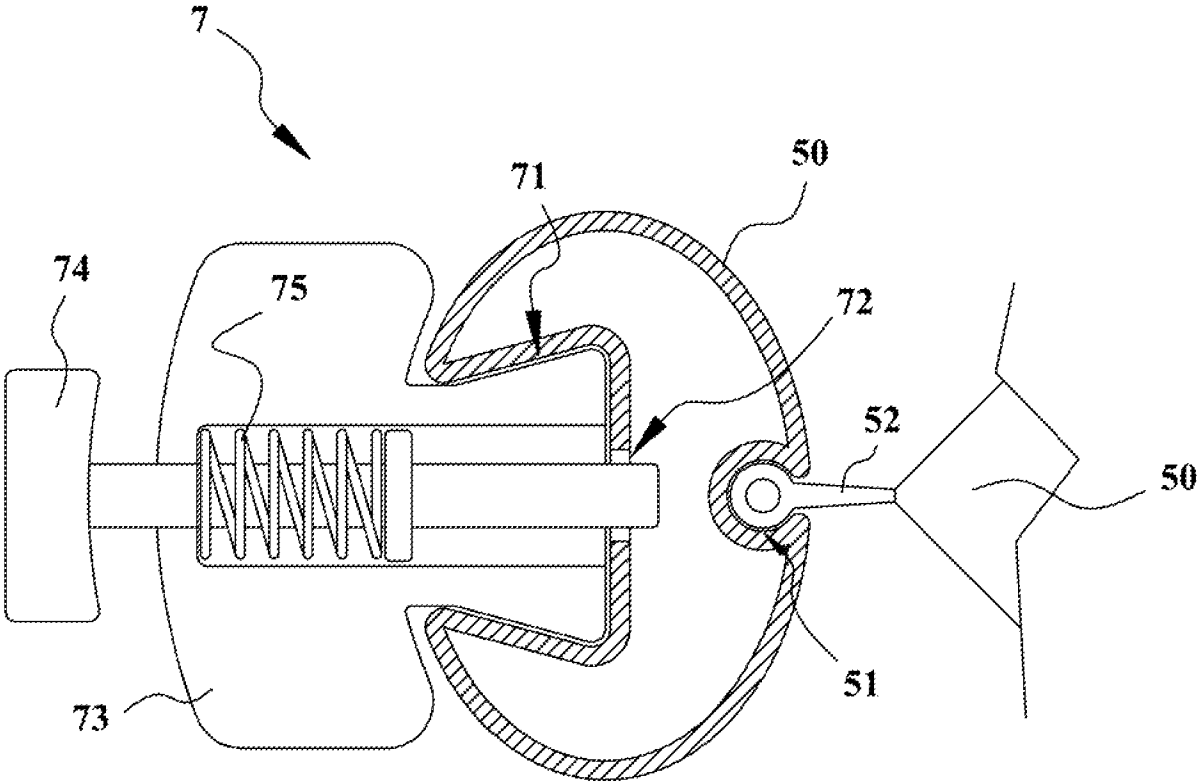
FIG. 4 is a schematic cross-sectional view of a height adjustment positioning mechanism.

FIG. 4 is a variant embodiment of a height adjustment positioning mechanism 7, which is featured in that a guide slot 71 is disposed on the vertical poles 50, and vertically aligned position holes 72 are disposed on the guide slot 71. The top edge 63 of the seat fabric 60, especially at the corner, is connected with a slide base 73 which can slide in the guide slot 71, and a removable positioning pole 74 is disposed in the slide base 73. Furthermore, an elastic element 75 can be used to keep the positioning pole 74 being engaged with one of positioning holes 72 for positioning the slide base 73. When the positioning pole 74 escapes from the positioning hole 72, the slide base 73 can be resumed to slide along the guide slot 71 so as to pull the seat fabric 60 to move towards outside, upwards or downwards, thereby altering the height of the bottom surface 62 of the seat fabric 60 from the ground. In addition, a guide groove 51 can be disposed on an inner side of each of the vertical poles 50, and a support piece 52 is connected between the guide groove 51 and a lower side of the seat fabric 60, so that the support piece 52 can slide in the guide groove 51, thereby moving away the lower portion of the seat fabric for conveniently pulling or withdrawing the seat fabric 60 from the top of the sides 61.

Figure 5:
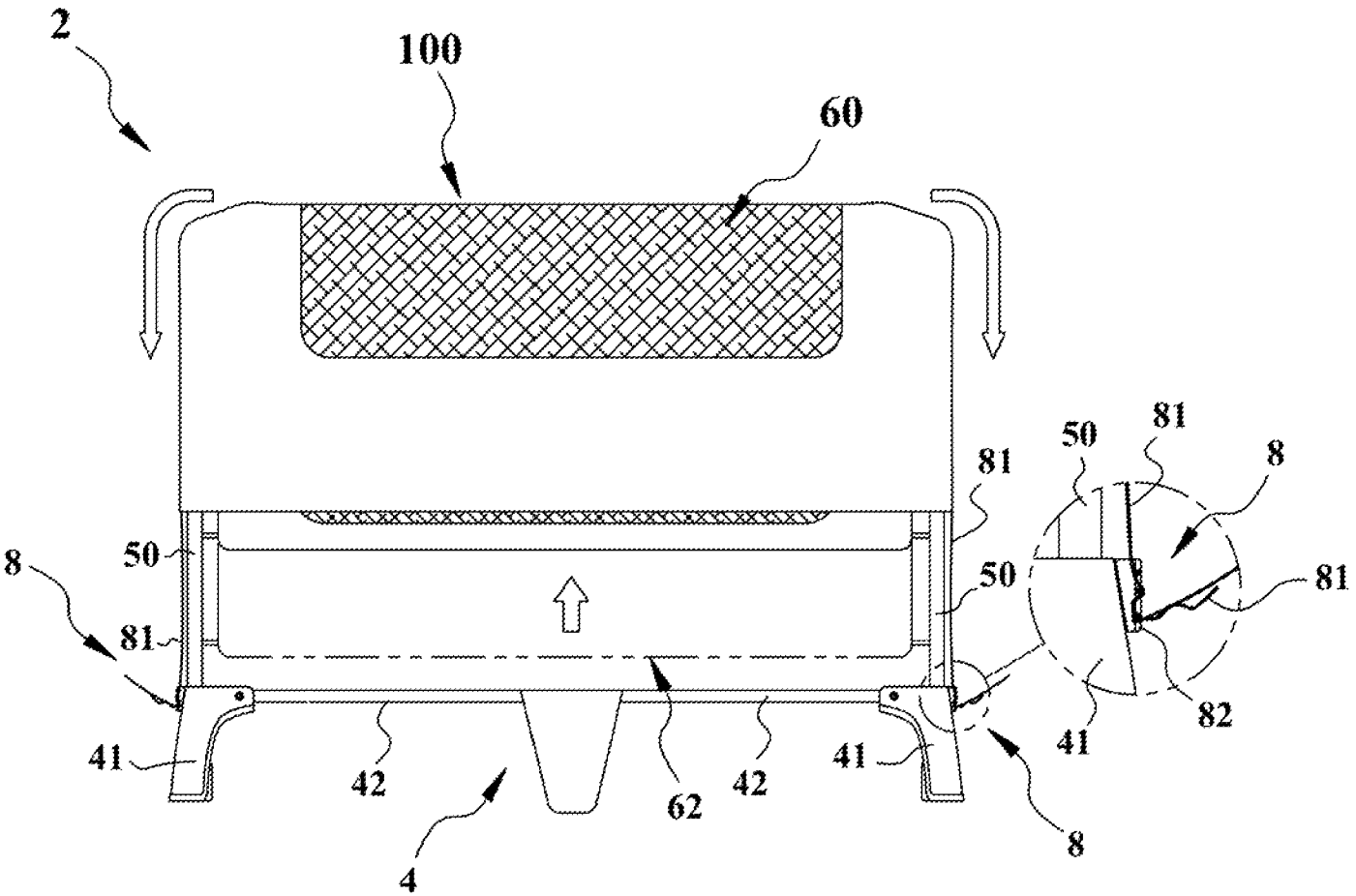
FIG. 5 is a schematic side view showing the movement of the height adjustment positioning mechanism by adjusting the length of a stripe.

FIG. 5 is another embodiment of a height adjustment positioning mechanism 8, which includes adjustment stripes 81 respectively connected to appropriate positions of the top edges 63 of the four sides 61 of the seat fabric 60, wherein the adjustment stripes 81 extend downwards and pass through the bottom frame set 4 and a length adjuster 82. The length adjuster 82 can also be disposed on the upper corner holders 31, the lower corner stands 41, the vertical poles 50, etc., to alter an extension length of the adjustment stripes 81 through the length adjuster 82, thereby pulling the seat fabric 60 to move towards outside, upwards or downwards, thus altering the height of the bottom surface 62 of the seat fabric 60 from the ground.

Figure 6:
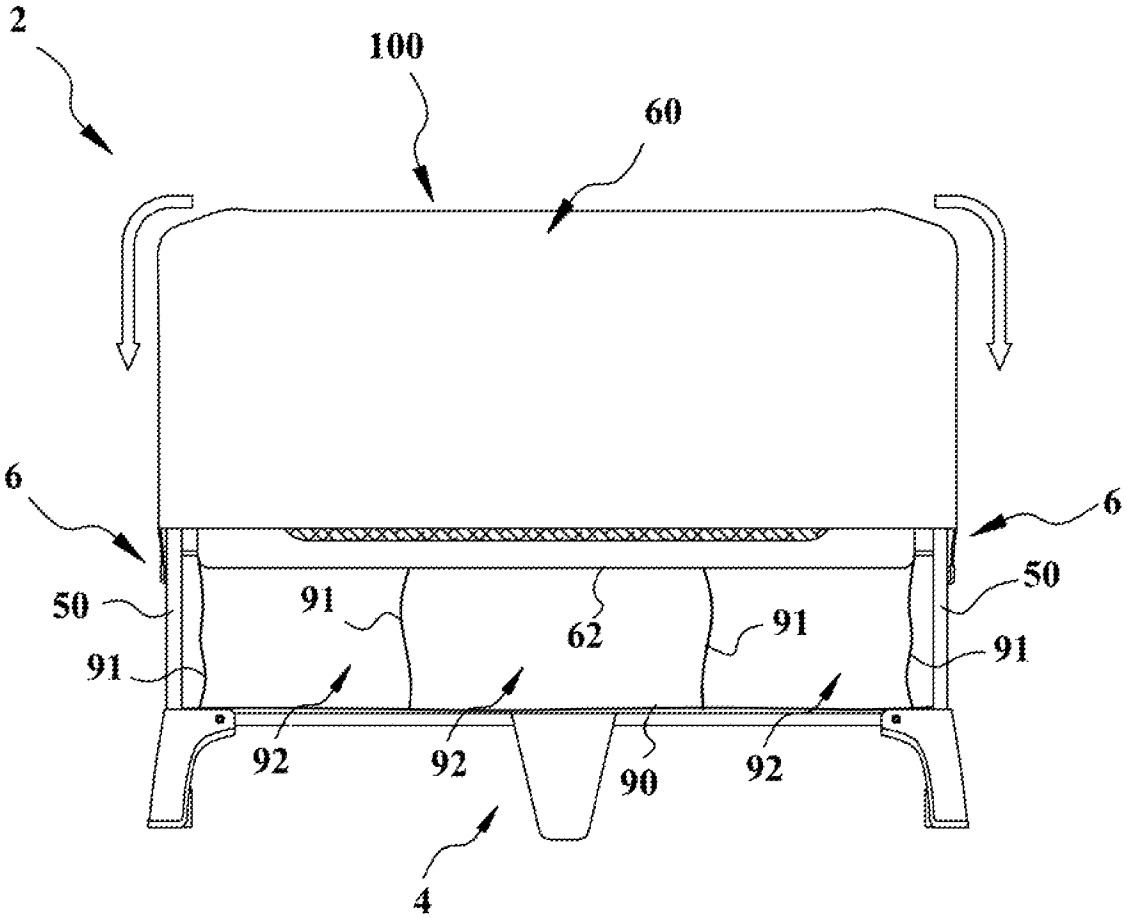
FIG. 6 is a schematic side view showing a receiving space constructed by vertical plates after the height is adjusted.

As shown in FIG. 6, a support plate 90 can be fixed on a plane of the bottom frame set 4, and a soft vertical piece 91 can be vertically connected to both sides or appropriate positions of the bottom surface 62, wherein the soft vertical piece 91 can be a woven fabric. The vertical pieces 91, the bottom surface 62 and the support plate 90 construct a receiving space 92 when the seat fabric moves upwards to increase the height of the bottom surface 62, thereby conveniently placing baby supplies such as diapers, etc.

When the adjustment mechanism of the present invention for altering the height of a bottom surface of a baby playpen from the ground is used, the seat fabric and the mattress can be placed in the foldable skeleton respectively. When not being in use, the playpen can be folded as shown in FIG. 7. The present invention have the advantages of greatly saving space; using the height adjustment mechanism including hooks, guide slots, etc. to control the folding of the seat fabric, thus facilitating to alter the height of the bottom surface from the ground; and providing the receiving space of the bottom frame set for placing daily supplies therein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An adjustment mechanism for altering a height of a baby playpen from a ground to a bottom of the baby playpen, the adjustment mechanism comprising:

a foldable skeleton, wherein the foldable skeleton is formed by assembling an upper foldable surrounding set, a bottom frame set and a plurality of vertical poles which are disposed between the upper foldable surrounding set and the bottom frame set, and each of the vertical poles has a guide slot of which a sidewall has a plurality of positioning holes;

a seat fabric, slideably put on the foldable skeleton to construct a plurality of side surface and a bottom surface for forming an accommodation space; and a height adjustment positioning mechanism disposed between the foldable skeleton and the seat fabric thereby altering the height of the bottom surface from the ground by adjusting the seat fabric, and the height adjustment positioning mechanism comprising:

a slide base which is connected with the seat fabric and can slide upwards and downwards along the guide slot; and a positioning pole slidably disposed between the vertical pole and the slide base, wherein the height of the bottom surface from the around is fixed by engaging the positioning pole with one of the positioning holes.

2. The adjustment mechanism of claim 1, wherein a plurality of positioning portions are disposed on the vertical poles.

3. The adjustment mechanism of claim 1, wherein an elastic element is disposed between the positioning pole and the slide base for keeping the engagement between the positioning pole and the positioning hole.

* * * * *